US007179428B2

(12) United States Patent
Dries

(10) Patent No.: US 7,179,428 B2
(45) Date of Patent: Feb. 20, 2007

(54) FCC APPARATUS

(75) Inventor: Hubertus Wilhelmus Albertus Dries, Amsterdam (NL)

(73) Assignee: Shell Oil Company, Houston, TX (US)

( * ) Notice: Subject to any disclaimer, the term of this patent is extended or adjusted under 35 U.S.C. 154(b) by 464 days.

(21) Appl. No.: 10/468,580

(22) PCT Filed: Feb. 21, 2002

(86) PCT No.: PCT/EP02/01871

§ 371 (c)(1),
(2), (4) Date: Dec. 3, 2003

(87) PCT Pub. No.: WO02/068566

PCT Pub. Date: Sep. 6, 2002

(65) Prior Publication Data

US 2004/0094456 A1 May 20, 2004

(30) Foreign Application Priority Data

Feb. 22, 2001 (EP) ..... 01200663

(51) Int. Cl.
*B32B 5/02* (2006.01)
*B32B 27/04* (2006.01)

(52) U.S. Cl. ..... 422/144; 422/145; 422/147

(58) Field of Classification Search ..... 422/144, 422/145, 147
See application file for complete search history.

(56) References Cited

U.S. PATENT DOCUMENTS 2,958,653 A 11/1960 Kruse, Jr.
4,289,729 A * 9/1981 Myers et al. ..... 422/144
5,039,397 A 8/1991 Haddad et al.
5,139,748 A 8/1992 Lomas et al.
5,562,818 A * 10/1996 Hedrick ..... 208/163
5,591,411 A * 1/1997 Terry et al. ..... 422/139
5,705,130 A * 1/1998 Hedrick ..... 422/145
6,042,717 A * 3/2000 Radcliffe et al. ..... 208/163
6,146,519 A * 11/2000 Koves ..... 208/146
6,627,161 B1 * 9/2003 Radcliffe et al. ..... 422/139
6,830,734 B1 * 12/2004 Dirkse et al. ..... 422/144
6,846,463 B1 * 1/2005 Dries et al. ..... 422/147
2004/0115102 A1 * 6/2004 Chen et al. ..... 422/147
2006/0059870 A1 * 3/2006 Beech et al. ..... 55/345

FOREIGN PATENT DOCUMENTS

EP 332277 9/1989

OTHER PUBLICATIONS

International Search Report dated Jul. 1, 2002.

* cited by examiner

*Primary Examiner*—N. Bhat
(74) *Attorney, Agent, or Firm*—William E. Hickman

(57) ABSTRACT

The invention is related to a fluid catalytic cracking (FCC) reactor having an elongated reactor riser and a reactor vessel. The reactor vessel has a dense phase fluidized stripping zone and a catalyst outlet at its lower end and at its upper end a cracked vapor outlet and a cyclone separator fluidly connected to the outlet of the reactor riser. The cyclone separator is provided with a dipleg which lower open end terminates below the upper bed level of the dense phase fluidized stripping zone.

18 Claims, 1 Drawing Sheet

FCC APPARATUS

FIELD OF THE INVENTION

The invention is related to a fluid catalytic cracking (FCC) reactor comprising an elongated reactor riser and a reactor vessel. The reactor vessel comprises a dense phase fluidized stripping zone and a catalyst outlet at its lower end and at its upper end a cracked vapour outlet and a cyclone separator fluidly connected to the outlet of the reactor riser. The cyclone separator is provided with a dipleg which lower open end terminates below the upper bed level of the dense phase fluidized stripping zone.

BACKGROUND OF THE INVENTION

An apparatus as described above is disclosed in U.S. Pat. No. 5,039,397. According to this publication the dipleg of the so-called close-bottomed cyclone separators are submerged in the catalyst bed to provide a seal, preventing cracked vapor to flow through the dipleg.

A problem often encountered is that pressure surges occur in the reactor riser due to for example equipment malfunctions, sudden vaporisation of water present in the hydrocarbon feedstock and/or various unit pressure upsets. In the event of a pressure surge the pressure imposed on the system by the catalyst bed around the submerged end of the dipleg as described in U.S. Pat. No. 5,039,397 will not be sufficient to prevent cracked vapour from flowing through the dipleg. This phenomenon is also referred to as "carry under" of the gasses flowing through the cyclone. This is disadvantageous because the cracked vapor contains relatively higher amounts of coke precursors than for example the hydrocarbons which are normally entrained by the catalyst which is discharged through the dipleg. These coke precursors give rise to an undesirable coke formation in the open volume above the dense fluidized bed of the stripping zone. This coke formation can result in that an FCC reactor needs to be shut down before the end of a process run. Removal of the coke is furthermore very laborious and time consuming.

The above problem is overcome by positioning a horizontal plate just below the lower open end of the dipleg. The plate ensures that in the event of a pressure surge no drastic increase in downflow of cracked vapor occurs via the dipleg. It is believed that this is achieved due to the back-pressure resulting from the catalyst being pressed, by the pressure surge, through the restricted opening between the plate and the catalyst discharge opening of the dipleg. Typically the plate has a diameter of more than 1.5 times the dipleg diameter. Examples of such prior art devices are illustrated in U.S. Pat. No. 2,958,653 and U.S. Pat. No. 5,139,748.

A disadvantage of the reactor vessel according to the prior art is that the plates occupy a large horizontal space in the reactor vessel. This results in that the vessel needs to have a larger diameter or that less diplegs and thus less cyclones can be used in one reactor vessel. Such geometrical limitations are for example encountered when more than one primary cyclone dipleg and more than one secondary cyclone dipleg are submerged in the dense phase fluidized stripping bed.

SUMMARY OF THE INVENTION

The present invention aims to provide an apparatus for performing an FCC process which apparatus minimises the risk that cracked vapours flow through the dipleg of the closed-bottomed cyclones in case of pressure surges.

Another object of the invention is to provide a compact design for the lower open end of the cyclone dipleg.

The above aims are achieved with the following fluid catalytic cracking reactor. Fluid catalytic cracking reactor comprising an elongated reactor riser and a reactor vessel, wherein the reactor vessel comprises a dense phase fluidized stripping zone and a catalyst outlet at its lower end, a cracked vapour outlet at its upper end and a cyclone separator fluidly connected to the outlet of the reactor riser, which cyclone separator is provided with a dipleg which lower open end terminates below the upper bed level of the dense phase fluidized stripping zone, the dense phase fluidized stripping zone further comprising a horizontal plate positioned below the lower open end of the dipleg, wherein the plate is a circular plate having a raised border and the lower open end of the dipleg is restricted and wherein the diameter (d3) of the circular plate inclusive the raised border is between 1.2 and 0.9 times the diameter of the dipleg.

DETAILED DESCRIPTION OF THE INVENTION

Figure 1:
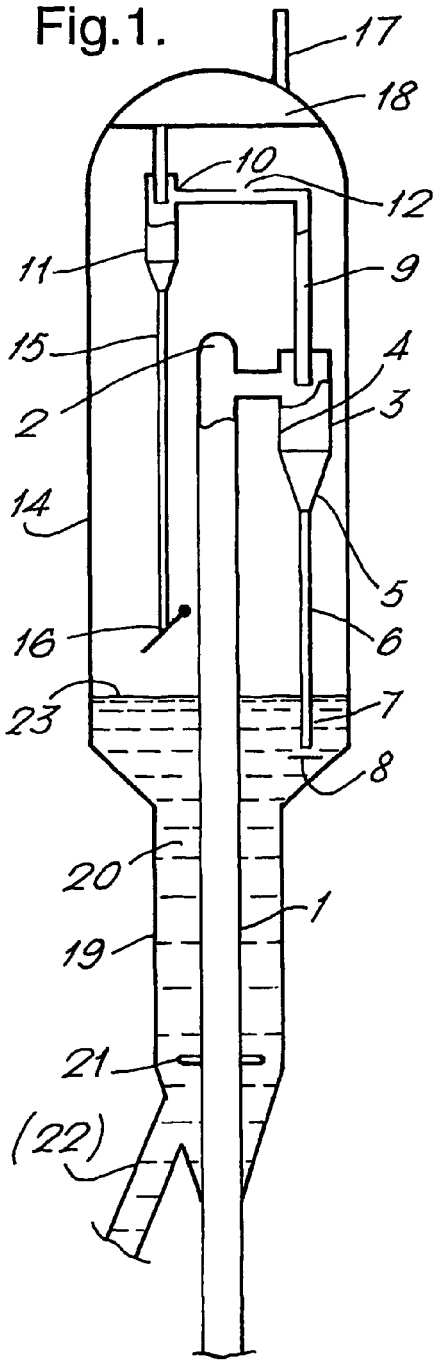
FIG. 1 is a representation of an FCC reactor according to the prior art.

It has been found that when the reactor according to the invention is used the area of the plate can be much smaller than when using a flat plate and a non-restricted open ended dipleg. Tests have shown that this embodiment comprising the modified plate and dipleg opening will. under normal conditions achieve the same objectives with regard to limiting gas carry under as the non-modified plate and dipleg of the prior art. The modified plate and dipleg furthermore avoid excessive gas carry under when the dense fluidized bed level of the stripping zone is temporally lower or when a pressure surge from the reactor riser takes place. This modified design also prevents the upflow of stripping and stripped gas out of the bed into the dipleg. Further preferred embodiments will become apparent from the description below.

The invention can find application in new FCC reactors or by modification of existing FCC reactors. Existing FCC reactors which may be modified to a reactor according the present invention will suitably comprise a reactor vessel comprising cyclone separation means fluidly connected to the downstream end of a reactor riser and a stripping zone at its lower end. Examples of such FCC reactors are illustrated in FIGS. 1–16, 1–17, 1–19, 1–21 and 1–22 as published in "Fluid Catalytic Cracking Technology and Operation" by Joseph W. Wilson, PennWell Publishing Company, Tulsa Okla. (US), 1997, pages 31–39. The illustrated reactors describe both embodiments wherein the upper end of the reactor riser is placed within the reactor vessel or placed outside the reactor vessel. For the present invention the location of the upper end of the reactor riser is not essential.

The cyclone separator which is provided with the plate at its lower dipleg end is a so-called rough cut cyclone or primary cyclone, in which the first separation is performed between catalyst and cracked vapor. Suitable 1 to 4 primary cyclones are fluidly connected to one reactor riser. The reactor vessel may be provided with further separation stages, for example secondary cyclones, to further separate catalyst fines from the cracked vapor. One primary cyclone may be fluidly connected to suitably 1 to 4 secondary cyclones. The design of the primary cyclone can vary, provided it is fluidly connected to a dipleg extending downwards. The cyclone may for example be a horizontal cyclone as described in EP-A-332277 hereby incorporated by reference or a conventional vertical cyclone. The dipleg itself has a relatively large cross-sectional area to accommodate the large quantities of catalyst which usually flow through such diplegs. The lower end is submerged in the dense fluidized bed of catalyst of the stripping zone. The height of the catalyst bed above the outlet opening of the dipleg should be sufficient to avoid, under normal operation, any gas carry under. This height can be easily determined by one skilled in the art.

The flow of catalyst in such a primary cyclone according to the present invention is suitably between 100 and 500 $kg/m^2 \cdot s$ as measured at the cross-sectional area of the dipleg just above the restriction.

FIG. 1 shows a downstream part of a reactor riser (1) positioned within the reactor vessel (14). Through reactor riser (1) catalyst and hydrocarbon feedstock flow upwardly in a dilute phase fluidized bed mode. The downstream part (2) of the reactor riser (1) is fluidly connected with a primary cyclone (3). Primary cyclone (3) comprises a tubular body (4), a frusto conical lower part (5) connected with a dipleg (6). The dipleg (6) has a smaller diameter than tubular body (3). Typically the diameter of the dipleg is between 0.2 and 0.7 times the diameter of the tubular body (4). Below the lower open end (7) of dipleg (6) a horizontal circular plate (8) is present. The diameter of such a plate (8) is typically between 1.5 and 2 times the diameter of the diameter of the dipleg (6). The partly cleaned cracked vapour is discharged via gas outlet conduit (9). This conduit is fluidly connected with gas inlet (10) of secondary cyclone (11). The gas outlet conduit (9) is provided with a slit (12) through which stripping gas can be discharged from reactor vessel (14) via the secondary cyclone (11). The secondary cyclone (11) is provided with a dipleg (15) provided at its lower end with a trickle valve (16) positioned above fluidized bed level (23). The cleaned gasses are discharged from the secondary cyclone (11) and from the reactor vessel (14) via plenum (18) and gas outlet conduit (17). In the lower end (19) of the reactor vessel (14) a stripping zone is present comprising of a dense phase fluidized bed (20). To the fluidized bed (20) a stripping and fluidizing medium, preferably steam, is supplied to via means (21). The stripped catalyst are discharged from the reactor vessel (14) via standpipe (22) to the regenerator zone (not shown).

Figure 2:
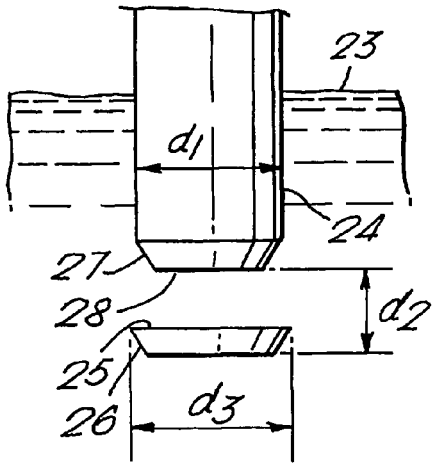
FIG. 2 is a detailed representation of the lower end of the dipleg showing the above described modified plate.

FIG. 2 shows the lower end of modified dipleg (24) and modified plate (25). Plate (25) may have any form, for example rectangular. Preferably plate (25) is circular. Plate (25) is provided with a raised border also referred to as rim (26). The lower end of the dipleg (24) is provided with a restriction (27). The diameter (d3) of the circular plate (25) inclusive the rim (26) is preferably between 1.2 and 0.9 times the diameter (d1) of the dipleg (24) and more preferably having about the same diameter. The distance (d2) between the base of plate (25) and the open lower end of the dipleg (24) is preferably between 0.2 and 0.8 times the diameter (d1) of the dipleg (24). The rim preferably extends between 20 and 40% of the distance (d2) above the base of the plate (25). The diameter of the restricted opening (28) in the dipleg is suitably between 0.4 and 0.7 times the diameter (d1) of the dipleg (24). The diameter of the flat part of the plate is about the same as the diameter of the opening (28). The rim (26) is preferably provided with openings near to the bottom of the plate in order to allow catalyst to flow from the plate when catalysts are removed from the vessel in for example a shut down operation. In other words the openings are to make the plate self-draining. The modified dipleg and plate as shown in FIG. 2 can suitably find application in the reactor vessel of FIG. 1.

The plate is preferably coated with an erosion resistance material, for example refractory material which is typically used in a FCC reactor vessel. The dimensions as stated above are calculated from the surface of the erosion resistant material, if present.

I claim:

1. A fluid catalytic cracking reactor, comprising: an elongated reactor riser having a downstream end outlet positioned within a reactor vessel having a lower end equipped with a catalyst outlet and an upper end equipped with a cracked vapor outlet, wherein the reactor vessel defines a dense phase fluidized stripping zone containing a dense phase fluidized bed of catalyst with an upper bed level, wherein within the reactor vessel is a cyclone separator fluidly connected to the downstream end outlet of the elongated reactor riser, which the cyclone separator is provided with a dipleg having a dipleg diameter (d1) and a lower open end having a restriction defining a restricted opening diameter, wherein the dipleg extends downwardly so that its lower open end terminates below the upper bed level of the dense phase fluidized bed of catalyst, wherein located within the dense phase fluidized stripping zone is a horizontal plate positioned at a distance (d2) below the lower open end of the dipleg, wherein the horizontal plate has a raised border and is defined by a plate diameter (d3), and wherein the plate diameter (d3) of the horizontal plate inclusive of the raised border is between 1.2 and 0.9 times the dipleg diameter (d1).

2. The fluid catalytic cracking reactor claim 1, wherein the restricted opening diameter of the restriction is between the dipleg diameter (d1) of the dipleg.

3. The fluid catalytic cracking reactor of claim 1, wherein the distance (d2) between the base of the horizontal plate and the lower open end of the dipleg is between 0.2 and 0.8 times the dipleg diameter (d1) of the dipleg.

4. The fluid catalytic cracking reactor of claim 3, wherein the raised border (rim) extends between 20 and 40% of the distance d2 above the base of the horizontal plate, wherein the distance d2 is the distance between the base of the horizontal plate and the lower open end of the dipleg.

5. The fluid catalytic cracking reactor of claim 4, wherein openings are present in the raised border (rim), near to the bottom of the horizontal plate, in order to make the plate self-draining.

6. The fluid catalytic cracking reactor of claim 5, wherein the horizontal plate is coated with an erosion resistant material.

7. The fluid catalytic cracking reactor of claim 1, wherein the distance (d2) between the base of the horizontal plate and the lower open end of the dipleg is between 0.2 and 0.8 times the dipleg diameter (d1) of the dipleg.

8. The fluid catalytic cracking reactor of claim 1, wherein the raised border (rim) extends between 20 and 40% of the distance d2 above the base of the horizontal plate, wherein the distance d2 is the distance between the base of the horizontal plate and the lower open end of the dipleg.

9. The fluid catalytic cracking reactor of claim 2, wherein the raised border (rim) extends between 20 and 40% of the distance d2 above the base of the horizontal plate, wherein the distance d2 is the distance between the base of the horizontal plate and the lower open end of the dipleg.

10. The fluid catalytic cracking reactor of claim 1, wherein openings are present in the raised border, near to the bottom of the horizontal plate, in order to make the horizontal plate self-draining.

11. The fluid catalytic cracking reactor of claim 2, wherein openings are present in the raised border, near to the bottom of the horizontal plate, in order to make the horizontal plate self-draining.

12. The fluid catalytic cracking reactor of claim 3, wherein openings are present in the raised border, near to the bottom of the horizontal plate, in order to make the horizontal plate self-draining.

13. The fluid catalytic cracking reactor of claim 4, wherein the horizontal plate is coated with an erosion resistant material.

14. The fluid catalytic cracking reactor of claim 2, wherein the horizontal plate is coated with an erosion resistant material.

15. The fluid catalytic cracking reactor of claim 3, wherein the horizontal plate is coated with an erosion resistant material.

16. The fluid catalytic cracking reactor of claim 4, wherein the plate is coated with an erosion resistant material.

17. A method comprising using the fluid catalytic cracking reactor of claim 1 in a fluid catalytic cracking process by introducing catalyst and hydrocarbon feedstock into the elongated reactor riser.

18. A method as recited in claim 17, wherein the flow of catalyst through the dipleg of the cyclone separator is between 100 $kg/m^2$ and 500 $kg/m^2$ as calculated on the cross-sectional area of the dipleg just above the restriction.

* * * * *